US011832043B2

(12) United States Patent
Tu et al.

(10) Patent No.: US 11,832,043 B2
(45) Date of Patent: Nov. 28, 2023

(54) MICROPHONE AND METHOD FOR MANUFACTURING THE SAME

(71) Applicant: AAC ACOUSTIC TECHNOLOGIES (SHENZHEN) CO., LTD., Shenzhen (CN)

(72) Inventors: Lanlan Tu, Shenzhen (CN); Wooicheang Goh, Singapore (SG); Kahkeen Lai, Singapore (SG)

(73) Assignee: AAC Acoustic Technologies (Shenzhen) Co., Ltd., Shenzhen (CN)

( * ) Notice: Subject to any disclaimer, the term of this patent is extended or adjusted under 35 U.S.C. 154(b) by 0 days.

(21) Appl. No.: 17/743,482

(22) Filed: May 13, 2022

(65) Prior Publication Data

US 2023/0217146 A1 Jul. 6, 2023

(30) Foreign Application Priority Data

Dec. 31, 2021 (CN) ..... 202111670303.0

(51) Int. Cl.
*H04R 1/08* (2006.01)
*H04R 1/32* (2006.01)

(52) U.S. Cl.
CPC ..... *H04R 1/083* (2013.01); *H04R 1/326* (2013.01); *H04R 2201/029* (2013.01); *H04R 2499/11* (2013.01)

(58) Field of Classification Search
CPC ..... H04R 1/083; H04R 1/326; H04R 19/005
See application file for complete search history.

(56) References Cited

U.S. PATENT DOCUMENTS

| | | | | |
|---|---|---|---|---|
| 5,490,220 A * | 2/1996 | Loeppert | G01H 11/06 381/113 |
| 2007/0165888 A1* | 7/2007 | Weigold | H04R 7/20 381/174 |
| 2012/0087521 A1* | 4/2012 | Delaus | H04R 19/005 381/174 |
| 2018/0002168 A1* | 1/2018 | Cargill | B81B 3/0072 |
| 2022/0174422 A1* | 6/2022 | Wang | H04R 19/005 |

* cited by examiner

*Primary Examiner* — Suhan Ni
(74) *Attorney, Agent, or Firm* — W&G Law Group

(57) ABSTRACT

Provided is a microphone, including a base having a back cavity, a diaphragm, a backplate electrode, and a backplate spaced from the diaphragm and defining an inner cavity jointly with the diaphragm. The diaphragm includes a vibration portion, a fixing portion, and a leak hole. The back cavity is communicated with the inner cavity through the leak hole. The backplate is provided with a first through hole. The inner cavity is communicated with outside through the first through hole. The backplate includes a backplate body and a backplate extension portion. The inner cavity includes a first inner cavity and a second inner cavity. The backplate extension portion is provided with a second through hole, and the second inner cavity is communicated with outside through the second through hole. A method for manufacturing the microphone is further provided. The technical solution has better drop performance.

6 Claims, 9 Drawing Sheets

MICROPHONE AND METHOD FOR MANUFACTURING THE SAME

TECHNICAL FIELD

The present invention relates to the technical field of microphones, and in particular, to a microphone and a method for manufacturing the microphone.

BACKGROUND

With the development of wireless communication, there are more and more mobile phone users all over the world. The users require mobile phones to satisfy calls and to be capable of providing high-quality call effects. Especially with the development of current mobile multimedia technologies, the call quality of a mobile phone is more important. A microphone of the mobile phone serves as a voice pickup device of the mobile phone, and its design directly affects the call quality.

The microphone in the related art includes a base having a back cavity, a diaphragm arranged at a side of the base, and a backplate spaced from the diaphragm and forming an inner cavity jointly with the diaphragm. The diaphragm is provided with a leak hole passing therethrough, and the back cavity is communicated with the inner cavity through the leak hole. The backplate is provided with a through hole passing therethrough, and the inner cavity is communicated with outside through the through hole. The diaphragm includes a vibration portion directly opposite to the back cavity, and a fixing portion extending from an edge of the vibration portion and in insulated connection with the base. The leak hole passes through the vibration portion.

However, the through hole of the microphone in the related art is arranged in a middle region of the backplate, a part of the backplate connected to the base is of a backplate step structure, and the backplate step structure is not provided with the through hole. A drop test is one of the important indicators for microphone evaluation. In the drop test, the microphone in the related art may generally break at a position of the backplate step structure, resulting in a low product yield. According to analysis of experimental data, such a drop failure is caused by overdue discharge of gas in a space region between the backplate step structure and the fixing portion, resulting in great stress. The stress is concentrated at one position to cause the backplate to break at a position of the backplate step structure.

Therefore, there is a need to provide a microphone and a method for manufacturing a microphone with improvement, so as to solve the above problems.

SUMMARY

An objective of the present invention is to provide a microphone and a method for manufacturing a microphone with good drop performance to overcome the above technical problems.

In order to achieve the above objective, the present invention provides a microphone, including a base having a back cavity, a diaphragm arranged at a side of the base, a backplate spaced from the diaphragm, and a backplate electrode attached to the backplate. The backplate and the diaphragm jointly define an inner cavity. The diaphragm includes a vibration portion directly opposite to the back cavity, a fixing portion extending from an edge of the vibration portion and in insulated connection with the base, and a leak hole that passes through the vibration portion; and the back cavity is communicated with the inner cavity through the leak hole. The backplate is provided with a first through hole passing therethrough, and the inner cavity is communicated with outside through the first through hole. The backplate includes a backplate body and a backplate extension portion bending and extending from an edge of the backplate body toward a direction close to the base and fixed to the base; the inner cavity includes a first inner cavity defined by the backplate body and the vibration portion that are spaced from each other, and a second inner cavity defined by the backplate extension portion and the fixing portion that are spaced from each other; and the first inner cavity is communicated with the second inner cavity. The first through hole is provided at the backplate body, and the leak hole and the first through hole are connected to the first inner cavity. The backplate extension portion is provided with a second through hole passing therethrough, and the second inner cavity is communicated with outside through the second through hole.

In an improved embodiment, the backplate extension portion is of a step structure.

In an improved embodiment, the backplate extension portion includes a first step bending and extending from an edge of the backplate body toward a direction close to the base, a second step bending and extending from the first step toward a direction away from the backplate body and pressed on the fixing portion in an insulation manner, and a third step bending and extending from the second step toward a direction away from the backplate body and fixed to the base; the second inner cavity is defined jointly by the first step, the second step and the fixing portion; and the second through hole is provided at the first step.

In an improved embodiment, the microphone further includes an insulation layer. The insulation layer is arranged between the fixing portion and the base, and the third step is located at an outer side of the insulation layer.

In an improved embodiment, the backplate electrode is attached to a side of the backplate close to the first inner cavity.

In an improved embodiment, an orthographic projection of the backplate electrode in a direction of the diaphragm falls completely within the vibration portion.

The present invention further provides a method for manufacturing the microphone as described above, and the method includes steps of:

S1, providing a base layer, and depositing silicon oxide on a surface of the base layer to form a sacrificial layer;

S2, depositing the diaphragm at a side surface of the sacrificial layer away from the base layer, and then sequentially performing exposure and etching to form the vibration portion, the fixing portion, and the leak hole provided at the diaphragm;

S3, depositing silicon oxide at a side surface of the diaphragm away from the base layer to form an electrode gap layer, filling the leak hole with the deposited silicon oxide, and connecting the deposited silicon oxide to the sacrificial layer;

S4, depositing a plurality of backplate electrodes at a side surface of the electrode gap layer away from the base layer;

S5, depositing the backplate on the base layer, the electrode gap layer, and the plurality of backplate electrodes; and then sequentially performing exposure and etching to form the first through hole and the second through hole in the backplate;

S6, performing etching on the base layer to form the back cavity and the base; and S7, performing silicon wet etching to release the electrode gap layer and a part of the sacrificial layer to form the inner cavity, an insulation layer, and the leak hole communicating the inner cavity with the back cavity.

In an improved embodiment, the electrode gap layer is formed by successively depositing a first layer of silicon oxide and a second layer of silicon oxide that are close to the diaphragm. An area of the first layer of silicon oxide is greater than an area of the second layer of silicon oxide, the second layer of silicon oxide and a part of the first layer of silicon oxide that overlaps with the second layer of silicon oxide undergo silicon wet etching to be released to form the first inner cavity, and another part of the first layer of silicon oxide undergoes silicon wet etching to be released to form the second inner cavity.

In an improved embodiment, the diaphragm and the plurality of backplate electrodes are made of polysilicon.

In an improved embodiment, the backplate is made of silicon nitride.

Compared with the related art, according to the microphone in the present invention, the backplate includes a backplate body and a backplate extension portion bending and extending from an edge of the backplate body toward a direction close to the base and fixed to the base, a second inner cavity defined by the backplate extension portion and the fixing portion that are spaced from each other is formed, and the backplate extension portion is provided with a second through hole passing therethrough, such that the second inner cavity is communicated with outside through the second through hole. This structure enables air in the second inner cavity, which is defined by the backplate extension portion and the fixing portion that are spaced from each other, to be directly communicated with outside through the second through hole. When the microphone drops, the air in the second inner cavity can be discharged in time through the second through hole, thereby preventing generation of great stress on the backplate extension portion by the air in the second inner cavity and thus preventing breakage of the backplate extension portion. Therefore, the microphone and the method for manufacturing the microphone according to the present invention have good drop performance.

BRIEF DESCRIPTION OF DRAWINGS

In order to more clearly illustrate technical solutions in embodiments of the present invention, the accompanying drawings used in the embodiments are briefly introduced as follows. It should be noted that the drawings described as follows are merely part of the embodiments of the present invention, other drawings can also be acquired by those skilled in the art without paying creative efforts.

DESCRIPTION OF EMBODIMENTS

The technical solutions in the embodiments of the present invention are described in the following with reference to the accompanying drawings. It should be understood that the described embodiments are merely exemplary embodiments of the present invention, which shall not be interpreted as providing limitations to the present invention. All other embodiments obtained by those skilled in the art without creative efforts according to the embodiments of the present invention are within the scope of the present invention.

The present invention provides a microphone 100.

Figure 1:
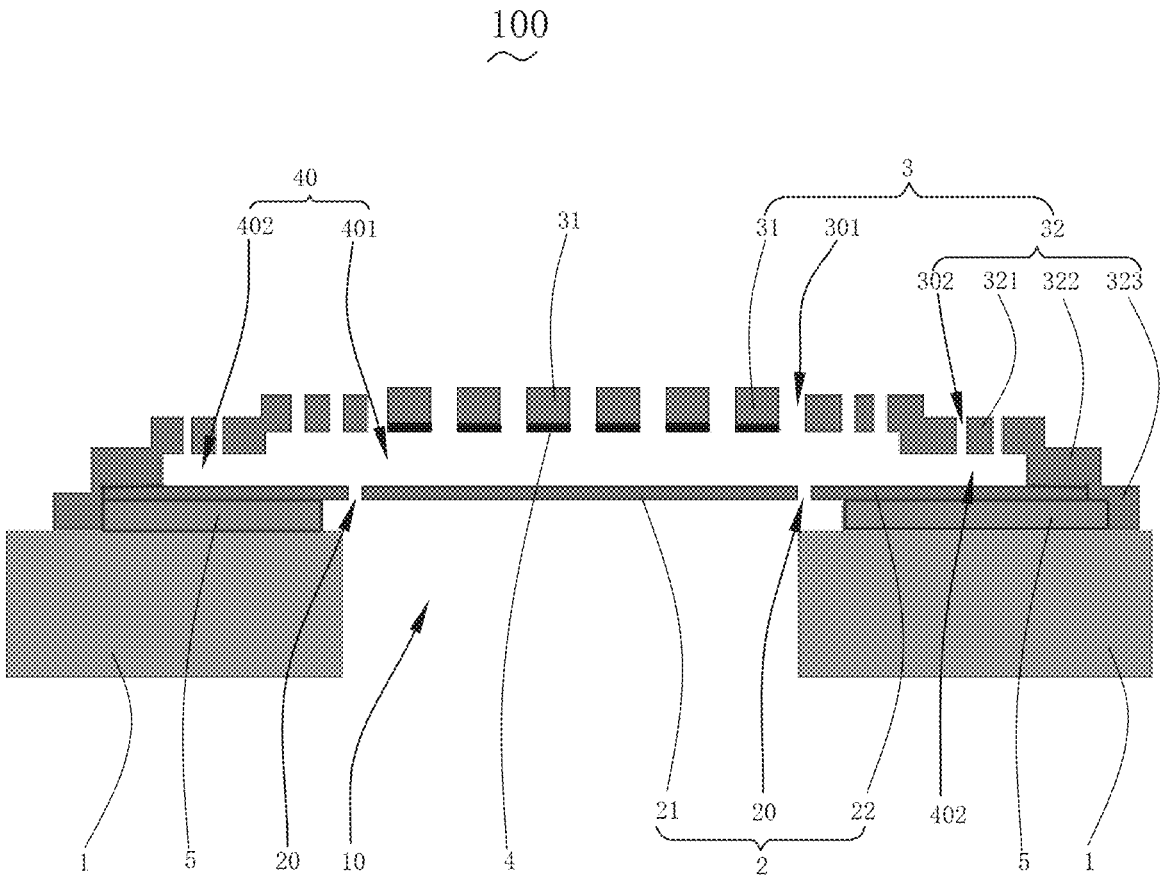
FIG. 1 is a schematic diagram of a sectional structure of a microphone according to an embodiment of the present invention.

FIG. 1 is a schematic diagram of a sectional structure of a microphone according to an embodiment of the present invention. Referring to FIG. 1, the microphone 100 includes a base 1, a diaphragm 2, a backplate 3, a backplate electrode 4, and an insulation layer 5.

The base 1 has a back cavity 10. The base 1 is made of a silicon-based semiconductor material.

The diaphragm 2 is arranged at a side of the base 1. The diaphragm 2 may be in a shape of a rectangle, or a circle, an oval, or the like. The diaphragm 2 is connected to the base 1 through the insulation layer 5.

In an emample, the diaphragm 2 includes a vibration portion 21 directly opposite to the back cavity 10, a fixing portion 22 extending from an edge of the vibration portion 21 and in insulated connection with the base 1, and a leak hole 20 passing through the vibration portion 21. The back cavity 10 is communicated with the inner cavity 40 through the leak hole 20. The insulation layer 5 is arranged between the fixing portion 22 and the base 1.

The backplate 3 is spaced from the diaphragm 2. The backplate 3 and the diaphragm 2 jointly define an inner cavity 40. When the microphone 100 is energized, the backplate 3 and the diaphragm 2 may carry opposite charges, thereby forming a capacitance. When the diaphragm 2 vibrates under an action of sound waves, a distance between the diaphragm 2 and the backplate 3 may change, resulting in a change in the capacitance. Then an acoustic signal is converted into an electrical signal to achieve corresponding functions of the microphone 100.

In an emample, the backplate 3 includes a backplate body 31 and a backplate extension portion 32 bending and extending from an edge of the backplate body 31 toward a direction close to the base 1 and fixed to the base 1. The inner cavity 40 includes a first inner cavity 401 defined by the backplate body 31 and the vibration portion 21 that are spaced from each other, and a second inner cavity 402 defined by the backplate extension portion 32 and the fixing portion 22 that are spaced from each other. The first inner cavity 401 is communicated with the second inner cavity 402.

The backplate 3 is provided with a first through hole 301 passing therethrough. In an example, the first through hole 301 is provided at the backplate body 31. The inner cavity 40 is communicated with outside through the first through hole 301. Both the leak hole 20 and the first through hole 301 are connected to the inner cavity 401.

The backplate extension portion 32 is provided with a second through hole 302 passing therethrough. The second inner cavity 402 is communicated with outside through the second through hole 302. This structure enables air in the second inner cavity 402, which is defined by the backplate extension portion 32 and the diaphragm 2 that are spaced from each other, to be directly communicated with outside through the second through hole 302. When the microphone drops, the air in the second inner cavity 402 can be discharged in time, thereby preventing generation of great stress on the backplate extension portion 32 by the air in the second inner cavity 402 and thus preventing breakage of the backplate extension portion 32. Therefore, the microphone 100 according to the present invention has good drop performance.

In the embodiments of the present invention, the backplate extension portion 32 is of a step structure. In an example, the backplate extension portion 32 includes a first step 321 bending and extending from an edge of the backplate body 31 toward a direction close to the base 1, a second step 322 bending and extending from the first step 321 toward a direction away from the backplate body 31 and pressed on the fixing portion 22 in an insulation manner, and a third step 323 bending and extending from the second step 322 toward a direction away from the backplate body 31 and fixed to the base 1. The second inner cavity 402 is defined jointly by the first step 321, the second step 322 and the fixing portion 22. The second through hole 302 is provided at the first step 321. The third step 323 is located at an outer side of the insulation layer 5. This structure facilitates the microphone 100 to be easily manufactured and have a solid structure, and improves the reliability of the microphone 100.

The backplate electrode 4 is attached to the backplate 3. The backplate electrode 4 is attached to a side of the backplate 3 close to the first inner cavity 401. When the backplate electrode 4 is energized, the backplate 3 and the diaphragm 2 may carry opposite charges, thereby forming a capacitance. In the embodiments of the present invention, an orthographic projection of the backplate electrode 4 in a direction of the diaphragm 2 falls completely within the vibration portion 21. This structure facilitates the formation of the capacitance with the diaphragm 2, thereby improving electrical performance of the microphone 100.

The insulation layer 5 is arranged between the fixing portion 22 and the base 1. The insulation layer 5 is made of an insulation material.

The present invention further provides a method for manufacturing the microphone 100.

Figure 2:
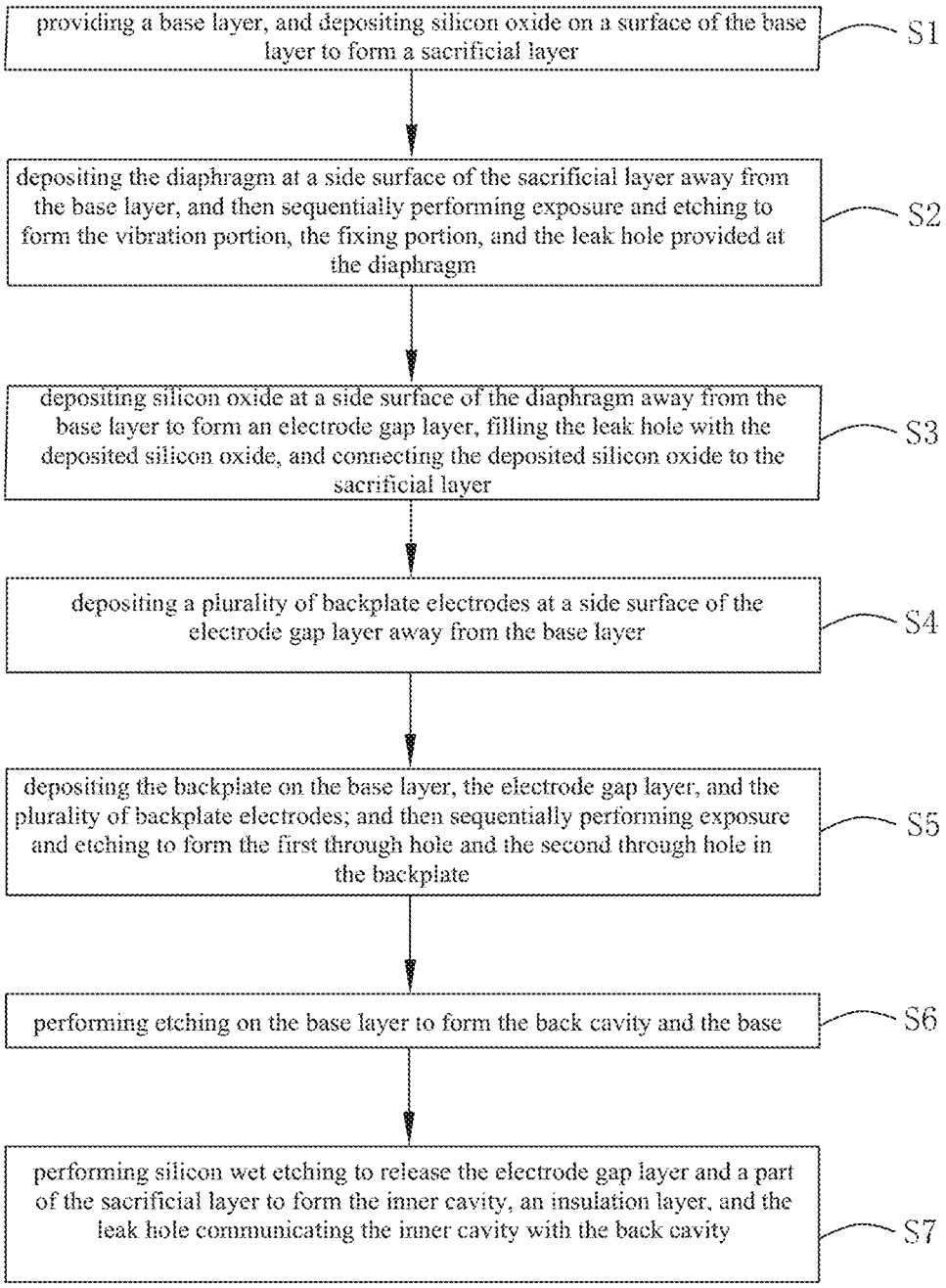
FIG. 2 is a schematic flowchart of a method for manufacturing a microphone according to an embodiment of the present invention.

FIG. 2 is a schematic flowchart of a method for manufacturing the microphone according to an embodiment of the present invention. Referring to FIG. 2, the method for manufacturing the microphone 100 includes the following steps.

At S1, a base layer 11 is provided, and silicon oxide is deposited on a surface of the base layer 11 to form a sacrificial layer 51.

Figure 3:
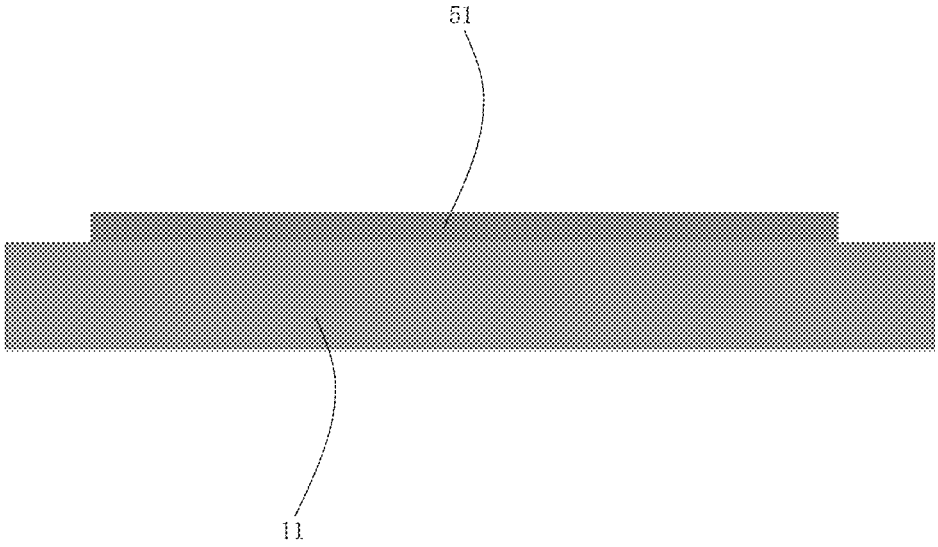
FIG. 3 is a schematic flowchart of a method for manufacturing a microphone corresponding to step S1 according to an embodiment of the present invention.

FIG. 3 is a schematic flowchart of a method for manufacturing a microphone corresponding to step S1 according to an embodiment of the present invention.

At S2, the diaphragm 2 is deposited at a side surface of the sacrificial layer 51 away from the base layer 11, and then exposure and etching are sequentially performed to form the vibration portion 21, the fixing portion 22, and the leak hole 20 provided at the diaphragm 2. In an embodiment of the present invention, the diaphragm 2 is made of polysilicon.

Figure 4:
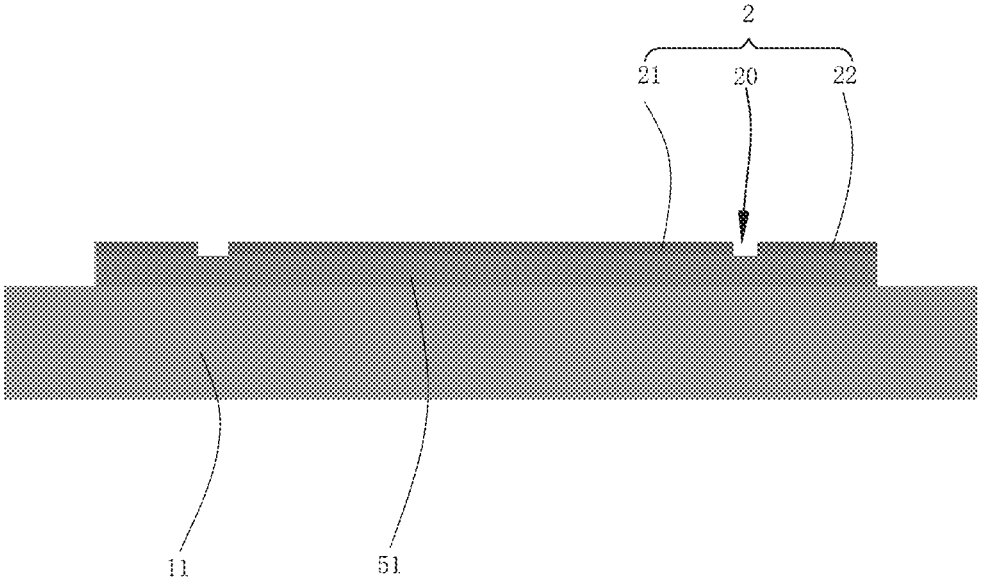
FIG. 4 is a schematic flowchart of a method for manufacturing a microphone corresponding to step S2 according to an embodiment of the present invention.

FIG. 4 is a schematic flowchart of a method for manufacturing a microphone corresponding to step S2 according to an embodiment of the present invention.

At S3, silicon oxide is deposited at a side surface of the diaphragm 2 away from the base layer 11 to form an electrode gap layer 400, and the deposited silicon oxide fills the leak hole 20 and is connected to the sacrificial layer 51.

Figure 5:
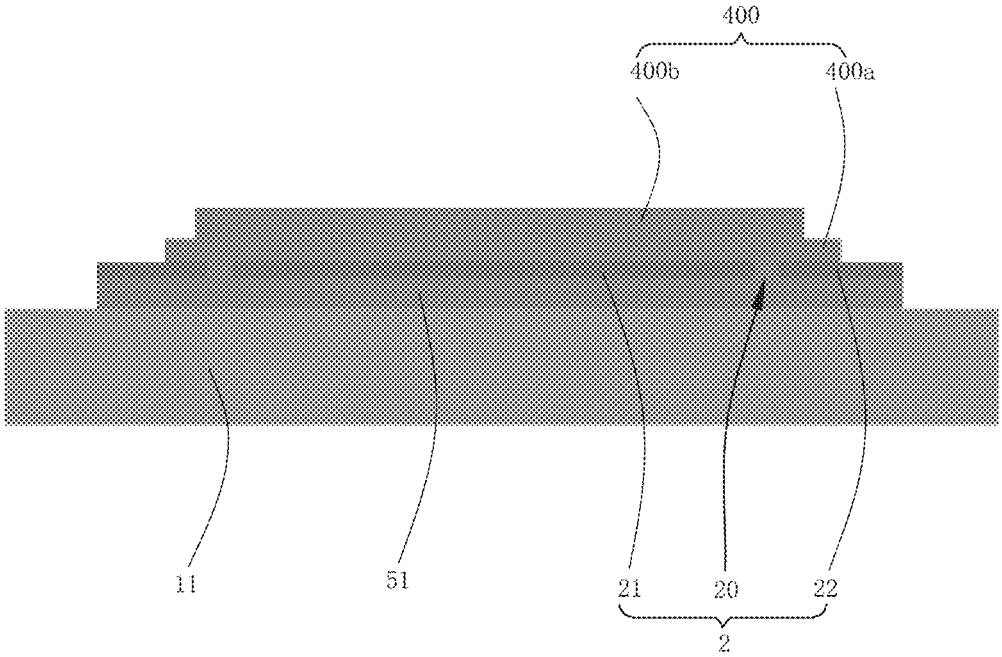
FIG. 5 is a schematic flowchart of a method for manufacturing a microphone corresponding to step S3 according to an embodiment of the present invention.

FIG. 5 is a schematic flowchart of a method for manufacturing a microphone corresponding to step S3 according to an embodiment of the present invention. The electrode gap layer 400 is formed by successively depositing a first layer of silicon oxide **400*a* and a second layer of silicon oxide 400*b* that are close to the diaphragm 2. An area of the first layer of silicon oxide 400*a* is greater than that of the second layer of silicon oxide 400*b*, the second layer of silicon oxide 400*b* and a part of the first layer of silicon oxide 400*a* that overlaps with the second layer of silicon oxide 400*b* undergo silicon wet etching to be released to form a first inner cavity 401, and another part of the first layer of silicon oxide 400*a* undergoes silicon wet etching to be released to form a second inner cavity 402**.

At S4, a plurality of backplate electrodes 4 are deposited at a side surface of the electrode gap layer 400 away from the base layer 1. In an embodiment of the present invention, the plurality of backplate electrodes 4 are made of polysilicon.

Figure 6:
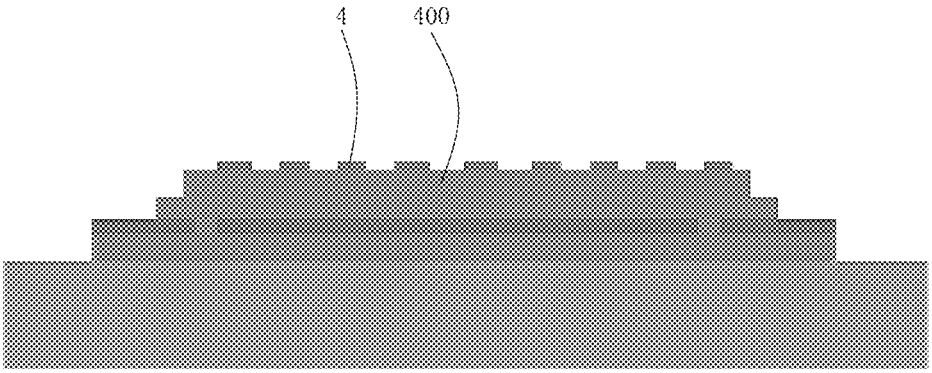
FIG. 6 is a schematic flowchart of a method for manufacturing a microphone corresponding to step S4 according to an embodiment of the present invention.

FIG. 6 is a schematic flowchart of a method for manufacturing a microphone corresponding to step S4 according to an embodiment of the present invention.

At S5, the backplate 3 is deposited on the base layer 11, the electrode gap layer 400, and the backplate electrode 4, and then exposure and etching are sequentially performed to form the first through hole 301 and the second through hole 302 at the backplate 3. In an embodiment of the present invention, the backplate 3 is made of silicon nitride.

Figure 7:
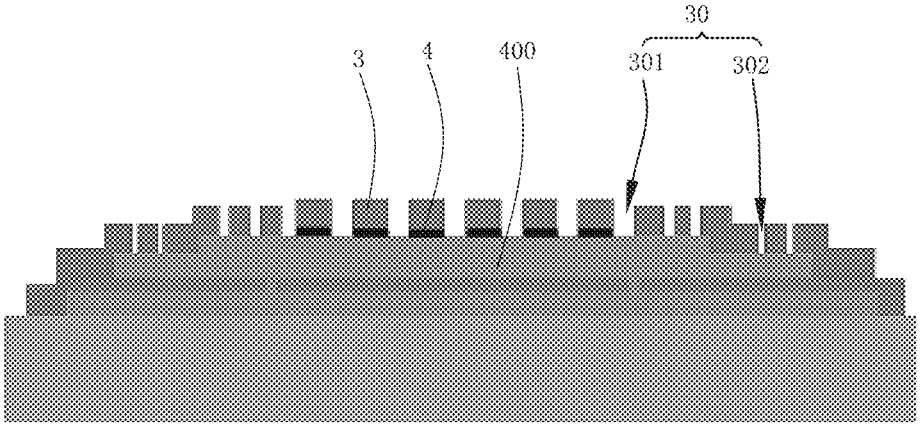
FIG. 7 is a schematic flowchart of a method for manufacturing a microphone corresponding to step S5 according to an embodiment of the present invention.

FIG. 7 is a schematic flowchart of a method for manufacturing a microphone corresponding to step S5 according to an embodiment of the present invention.

At S6, etching is performed on the base layer 11 to form the back cavity 10 and the base 1.

Figure 8:
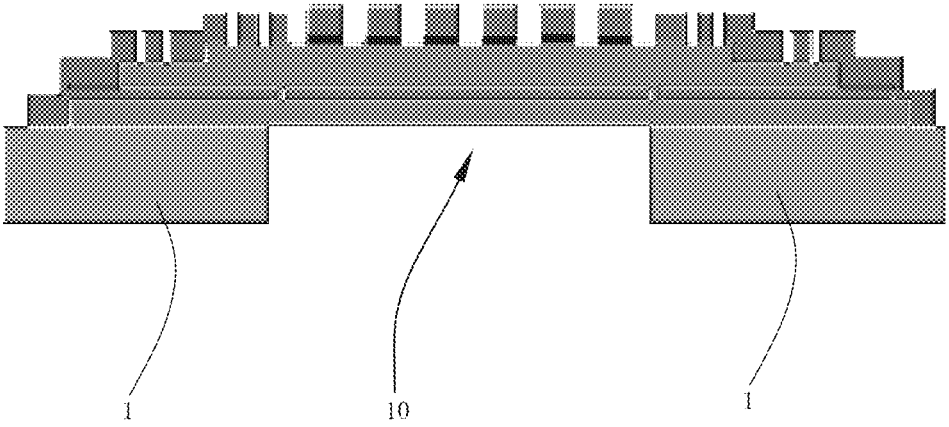
FIG. 8 is a schematic flowchart of a method for manufacturing a microphone corresponding to step S6 according to an embodiment of the present invention.

FIG. 8 is a schematic flowchart of a method for manufacturing a microphone corresponding to step S6 according to an embodiment of the present invention.

At S7, silicon wet etching is performed to release the electrode gap layer 400 and a part of the sacrificial layer 51 to form the inner cavity 40, an insulation layer 5, and the leak hole 20 communicating the inner cavity 40 with the back cavity 10.

Figure 9:
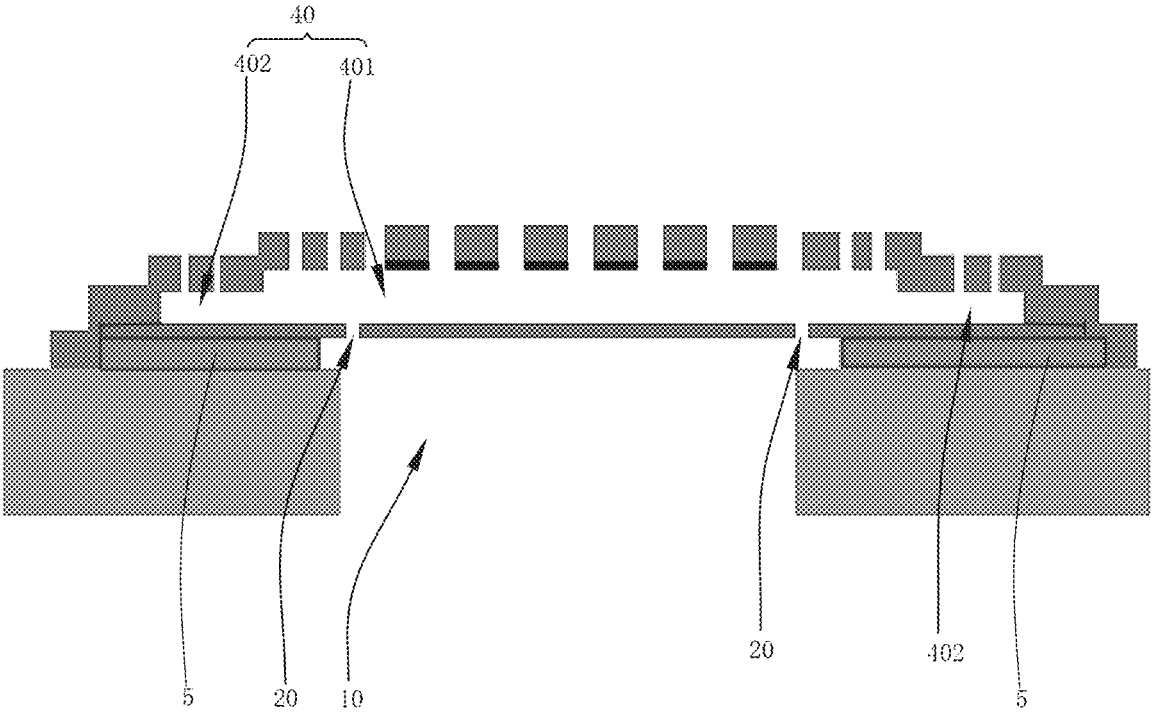
FIG. 9 is a schematic flowchart of a method for manufacturing a microphone corresponding to step S7 according to an embodiment of the present invention.

FIG. 9 is a schematic flowchart of a method for manufacturing a microphone corresponding to step S7 according to an embodiment of the present invention.

The microphone 100 can be manufactured through steps S1 to S9. Therefore, the method for manufacturing the microphone 100 according to the present invention has good drop performance.

Compared with the related art, according to the microphone in the present invention, the backplate includes a backplate body and a backplate extension portion bending and extending from an edge of the backplate body toward a direction close to the base and fixed to the base, a second inner cavity defined by the backplate extension portion and the fixing portion that are spaced from each other is formed, and the backplate extension portion is provided with a second through hole passing therethrough, such that the second inner cavity is communicated with outside through the second through hole. This structure enables air in the second inner cavity, which is defined by the backplate extension portion and the fixing portion that are spaced from each other, to be directly communicated with outside through the second through hole. When the microphone drops, the air in the second inner cavity can be discharged in time through the second through hole, thereby preventing generation of great stress on the backplate extension portion by the air in the second inner cavity and thus preventing breakage of the backplate extension portion. Therefore, the microphone and the method for manufacturing the microphone according to the present invention have good drop performance.

The above are only embodiments of the present invention and not thus intended to limit the patent scope of the present invention. All equivalent structures or equivalent flow transformations made by virtue of contents of the specification and the drawings of the present invention or direct or indirect application of the contents to the other related technical fields shall fall within the protection scope of the present invention.

What is claimed is:

1. A microphone, comprising a base having a back cavity, a diaphragm arranged at a side of the base, a backplate spaced from the diaphragm, and a backplate electrode attached to the backplate, wherein the backplate and the diaphragm jointly define an inner cavity;

the diaphragm comprises a vibration portion directly opposite to the back cavity, a fixing portion extending from an edge of the vibration portion and in insulated connection with the base, and a leak hole that passes through the vibration portion; and the back cavity is communicated with the inner cavity through the leak hole;

the backplate is provided with a first through hole passing therethrough, and the inner cavity is communicated with outside through the first through hole;

the backplate comprises a backplate body and a backplate extension portion bending and extending from an edge of the backplate body toward a direction close to the base and fixed to the base; the inner cavity comprises a first inner cavity defined by the backplate body and the vibration portion that are spaced from each other, and a second inner cavity defined by the backplate extension portion and the fixing portion that are spaced from each other; and the first inner cavity is communicated with the second inner cavity;

the first through hole is provided at the backplate body, and the leak hole and the first through hole are connected to the first inner cavity; and the backplate extension portion is provided with a second through hole passing therethrough, and the second inner cavity is communicated with outside through the second through hole.

2. The microphone as described in claim 1, wherein the backplate extension portion is of a step structure.

3. The microphone as described in claim 1, wherein the backplate extension portion comprises a first step bending and extending from an edge of the backplate body toward a direction close to the base, a second step bending and extending from the first step toward a direction away from the backplate body and pressed on the fixing portion in an insulation manner, and a third step bending and extending from the second step toward a direction away from the backplate body and fixed to the base; the second inner cavity is defined jointly by the first step, the second step and the fixing portion; and the second through hole is provided at the first step.

4. The microphone as described in claim 3, further comprising an insulation layer, wherein the insulation layer is arranged between the fixing portion and the base, and the third step is located at an outer side of the insulation layer.

5. The microphone as described in claim 1, wherein the backplate electrode is attached to a side of the backplate close to the first inner cavity.

6. The microphone as described in claim 1, wherein an orthographic projection of the backplate electrode in a direction of the diaphragm falls completely within the vibration portion.

* * * * *